US010163593B2

(12) United States Patent
Takeda

(10) Patent No.: US 10,163,593 B2
(45) Date of Patent: Dec. 25, 2018

(54) TEMPERATURE SWITCH

(71) Applicant: Uchiya Thermostat Co., Ltd., Saitama-Ken (JP)

(72) Inventor: Hideaki Takeda, Saitama (JP)

(73) Assignee: Uchiya Thermostat Co., Ltd., Saitama (JP)

( * ) Notice: Subject to any disclaimer, the term of this patent is extended or adjusted under 35 U.S.C. 154(b) by 6 days.

(21) Appl. No.: 15/513,041

(22) PCT Filed: Jul. 9, 2015

(86) PCT No.: PCT/JP2015/069780
§ 371 (c)(1),
(2) Date: Mar. 21, 2017

(87) PCT Pub. No.: WO2016/063583
PCT Pub. Date: Apr. 28, 2016

(65) Prior Publication Data

US 2017/0294281 A1 Oct. 12, 2017

(30) Foreign Application Priority Data

Oct. 20, 2014 (JP) ..... 2014-213391

(51) Int. Cl.
*H01H 37/52* (2006.01)
*H01H 37/04* (2006.01)
(Continued)

(52) U.S. Cl.
CPC ..... *H01H 37/52* (2013.01); *H01H 37/04* (2013.01); *H01H 37/54* (2013.01); *H01H 37/64* (2013.01); *H01H 37/5418* (2013.01)

(58) Field of Classification Search
CPC ..... H01H 37/52; H01H 37/5409; H01H 37/5418; H01H 2037/525;
(Continued)

(56) References Cited

U.S. PATENT DOCUMENTS 3,084,237 A * 4/1963 Mentzer ..... H01H 61/02 337/103
3,569,888 A * 3/1971 Taylor ..... H01H 37/5418 337/113
(Continued)

FOREIGN PATENT DOCUMENTS

JP 06333477 A 12/1994
JP 2007171268 A 7/2007
WO WO-2008053575 A1 5/2008

OTHER PUBLICATIONS

"International Application No. PCT/JP2015/069780, International Search Report dated Sep. 29, 2015", w/ English Translation, (Sep. 29, 2015), 4 pgs.
(Continued)

*Primary Examiner* — Anatoly Vortman
*Assistant Examiner* — Jacob Crum
(74) *Attorney, Agent, or Firm* — Schwegman Lundberg & Woessner, P.A.

(57) ABSTRACT

A temperature switch 1 includes first terminal unit 2 having a first terminal 5 and a first fixed contact 6, a switch body unit 3 including a bimetal element 22 in which both ends engage a movable plate 15 holding, via an tongue portion 17, first and second fixed contacts 6 and 8 arranged in an internal center portion of an insulation material 10 at prescribed intervals and also holding a movable contact 18 arranged above them, and a second terminal unit 4 having a second terminal 7 and the second fixed contact 8. The first terminal unit 2, the switch body unit 3, and the second terminal unit 4 are sequentially arranged in line. At an ambient temperature, the bimetal element 22 deforms into a convex shape in the contact direction so as to push out the tongue portion 17 and the movable contact 18 at the center of the convex shape, and the movable contact 18 is closed with respect to the first and second fixed contacts 6 and 8 so that a current
(Continued)

flows between the first and second terminals 5 and 7. At an ambient temperature equal to or higher than a prescribed value, the bimetal element 22 causes inversion to become concave in the contact direction, releases the biasing force of the spring property toward the space above the tongue portion 17, the movable contact 18 moves away from the first and second fixed contacts 6 and 8, and a current is cut off.

8 Claims, 8 Drawing Sheets

(51) Int. Cl.
*H01H 37/64* (2006.01)
*H01H 37/54* (2006.01)

(58) Field of Classification Search
CPC ..... H01H 2037/5481; H01H 37/04; H01H 37/54; H01H 37/64
USPC ..... 337/109
See application file for complete search history.

(56) References Cited

U.S. PATENT DOCUMENTS 4,914,414 A * 4/1990 Ubukata ..... H01H 37/12 337/343
5,463,233 A * 10/1995 Norling ..... H01H 1/0036 257/254
6,144,541 A * 11/2000 Kato ..... H01H 73/303 337/333
6,211,582 B1 * 4/2001 Reimold ..... B29C 45/14221 307/117
6,741,159 B1 * 5/2004 Kuczynski ..... H01H 37/002 337/142
2002/0125981 A1 * 9/2002 Yu ..... H01H 13/568 337/367
2004/0100351 A1 * 5/2004 Unno ..... F04C 23/008 337/100
2007/0296540 A1 * 12/2007 Takeda ..... H01H 37/54 337/380
2010/0026446 A1 2/2010 Takeda
2014/0049355 A1 * 2/2014 Takeda ..... H01H 37/54 337/365
2014/0300445 A1 * 10/2014 Takeda ..... H01H 37/54 337/362

OTHER PUBLICATIONS

"International Application No. PCT/JP2015/069780, Written Opinion dated Sep. 29, 2015", (Sep. 29, 2015), 3 pgs.

* cited by examiner

TEMPERATURE SWITCH

PRIORITY APPLICATIONS

This application is a U.S. National Stage Filing under 35 U.S.C. 371 from International Application No. PCT/JP2015/069780, filed on 9 Jul. 2015, and published as WO2016/063583 on 28 Apr. 2016, which claims the benefit under 35 U.S.C. 119 to Japanese Application No. 2014-213391, filed on 20 Oct. 2014; which applications and publication are incorporated herein by reference in their entirety.

FIELD

The present invention is related to a temperature switch that uses a bimetal element, and more particularly to a compact temperature switch that passes or breaks a large current used by a compact electrical appliance that uses a large current.

BACKGROUND

Temperature switches using a bimetal element have conventionally been known. For example, a temperature switch having a configuration in which fixed contacts provided respectively to ends of two terminals that are arranged in parallel are opened and closed by a single movable contact that operates in accordance with the operations of the bimetal element is proposed (see Patent Document 1 for example).

In the temperature switch of Patent Document 1, the two terminals are arranged in parallel as described above and the current-passing direction is turned back at the contact part in the switch so that currents are passed only at a contact part in the switch and do not flow to other constituents such as a bimetal element, a movable plate, etc.

Because the current-passing direction is turned back at the contact part as described above resulting in a minimum current-passing path in the switch, i.e., a minimum internal resistance of the switch, the configuration generates a very small amount of heat due to electric resistance, and thus has solved the problem wherein the operation temperature of the switch becomes lower than the actual operation temperature that is set in advance.

This temperature switch is based on an assumption that voltages used by the embedded electric devices are low, causing no problems even with a short distance between the parallel terminals, and accordingly the configuration with the current-passing direction turning back at the contact mechanism has an advantage of being able to make the overall configuration of the temperature switch compact.

PRIOR ART DOCUMENT

Patent Document

[Patent Document 1] International Publication Pamphlet No. WO2008/053575

SUMMARY

Incidentally, in countries, where high commercial voltages such as 200V through 250V are supplied to standard homes etc., when for example an electric device such as a hairdryer having a temperature switch embedded in it uses a high voltage of 250V, there is a high possibility that the configuration, such as one for the temperature switch of Patent Document 1, with a small clearance between two parallel terminals of both of the current-passing directions will cause a short circuit of current between the terminals.

An increase in the distance between the terminals can eliminate this possibility. However, a greater clearance between two terminals arranged in parallel makes the overall configuration of the temperature switch correspondingly larger, and thus it is difficult to embed such a temperature switch in compact electric devices such as a hairdryer, which is problematic.

It is an object of the present invention to solve the above conventional problem, i.e., to provide a compact temperature switch that passes or breaks a large current used by a compact electric product that uses a large current.

In order to solve the above problem, a temperature switch according to the present invention includes a first terminal unit, a switch body unit and a second terminal unit that are sequentially arranged in line, wherein the first terminal unit includes a first terminal formed at an outer end and a first fixed contact provided at an inner end that is inside the switch body unit, the second terminal unit includes a second terminal formed at an outer end and a second fixed contact that is provided at an inner end inside the switch body unit and that has a prescribed interval from the first fixed contact, the switch body unit includes an insulation material, a movable plate and a bimetal element, the insulation material includes

- a first holding unit that holds a connection part between the first terminal and the first fixed contact,
- a second holding unit that holds a connection part between the second terminal and the second fixed contact, and
- a cantilever holding unit that holds the movable plate and the bimetal element in a state that one end of the movable plate and one end of the bimetal element overlap, the movable plate

- is set between the first holding unit and the second holding unit,
- includes a hook unit formed at an end opposite to the one end, and
- includes a tongue portion that is formed in a center portion and that is separated from a surrounding portion except a root portion, the tongue portion has

- one movable contact joined to a surface facing the first fixed contact and the second fixed contact, and
- a spring property of bending backward the movable contact in a direction in which the movable contact moves away from the first fixed contact and the second fixed contact, and the bimetal element

- holds an end opposite to the one end at the hook unit of the movable plate,
- inverts a bending-back direction into a shape that is concave in each contact direction when the movable contact opens with respect to the first fixed contact and the second fixed contact, and releases a biasing force of the spring property of the tongue portion, and
- inverts a bending-back direction into a shape that is convex in each contact direction when the movable contact closes with respect to the first fixed contact and the second fixed contact, and presses the tongue portion in the convex shaped center portion with respect to the first fixed contact and the second fixed contact.

The present invention can provide a compact temperature switch that passes or breaks a large current used by a compact electric product that uses a large current.

DESCRIPTION OF EMBODIMENTS

Hereinafter, detailed explanations will be given for the embodiments of the present invention. Note that a temperature switch according to the present invention is a compact temperature switch that passes or breaks a large current used by a compact electric product that uses a large current, such as a hairdryer etc.

EXAMPLE 1

Figure 1A:
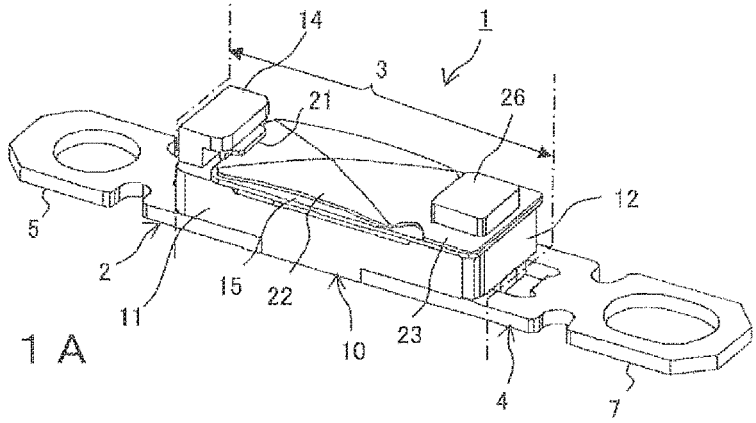
FIG. 1A is a side sectional view of a temperature switch according to example 1.
Figure 1B:
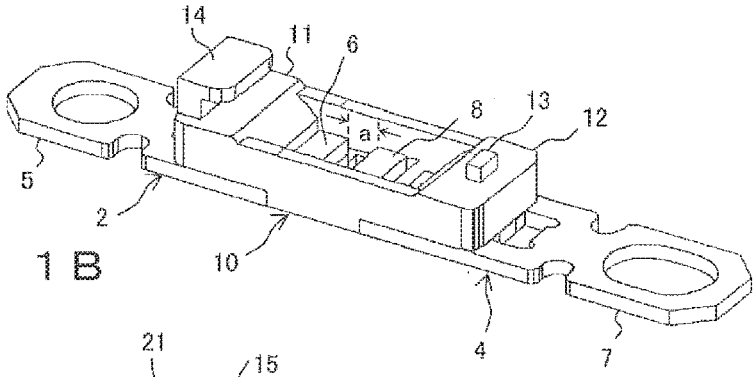
FIG. 1B is an exploded perspective view of FIG. 1A.

FIG. 1A is an appearance perspective view of a temperature switch according to example 1 of the present invention, and FIG. 1B through FIG. 1E are exploded perspective views of the temperature switch. As shown in FIG. 1A through FIG. 1D, a temperature switch 1 according to example 1 includes a first terminal unit 2, a switch body unit 3, and a second terminal unit 4, which are arranged in line.

The first terminal unit 2 includes a flat-plate metal material, and has a first terminal 5 formed at the outer end and a first fixed contact 6 provided in the inner end that is inside the switch body unit 3.

The second terminal unit 4 as well includes a fiat-plate metal material, and has a second terminal 7 formed at the outer end and a second fixed contact 8 provided at the inner end that is inside the switch body unit 3. The second fixed contact 8 is arranged with prescribed interval "a" from the first fixed contact 6.

Also, the switch body unit 3 has an insulation material 10, which integrates the first terminal unit 2 and the second terminal unit 4. The insulation material 10 has a first holding unit 11 that holds the connection part between the first terminal 5 and the first fixed contact 6, and a second holding unit. 12 that holds the connection part between the second terminal 7 and the second fixed contact 8.

Further, the insulation material 10 has, in the upper portion of one of the first holding unit 11 and the second holding unit 12 (the second holding unit 12 in the example shown in FIG. 1A and FIG. 1B), an insulation post 13 serving as a cantilever holding unit and having a rectangular section. Further, the insulation material 10 has an insulation hook unit 14 in the upper portion of the other of the first holding unit 11 and the second holding unit 12 (the first holding unit 11 in the example shown in FIG. 1A and FIG. 1B).

The above configuration is obtained by using rolled sheet materials for the first terminal unit 2 and the second terminal unit 4 and creating a necessary shape by pressing. Then, the first terminal unit. 2 and the second terminal unit 4 are molded integratedly with the insulation material 10 by resin molding, and the first fixed contact 6 and the second fixed contact 8 are respectively joined to the ends of both terminal units in the center portion.

Also, the switch body unit 3 has a movable plate 15. The movable plate 15 has, in its center portion, a tongue portion 17, which is separated from a surrounding portion 16 excluding the root portions. In other words, the movable plate 15 is divided into the tongue portion 17 and the surrounding portion 16.

This shape is formed so that the two members can be deformed independently and without interferences by removing the boundary between the two members by punching. One movable contact 18 is jointed in a fixed manner on the lower surface of the tongue portion 17.

Figure 1C:
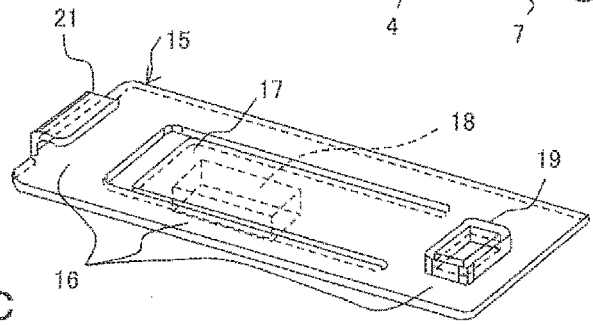
FIG. 1C is an exploded perspective view of FIG. 1A.
Figure 1D:
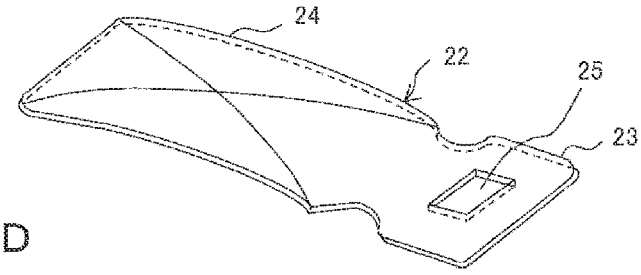
FIG. 1D is an exploded perspective view of FIG. 1A.
Figure 1E:
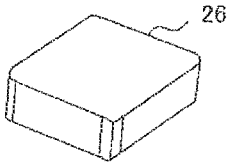
FIG. 1E is an exploded perspective view of FIG. 1A.

A post fitting unit 19 is formed at one end of this movable plate 15 in the longitudinal directions (the right end at which the tongue portion 17 is connected to the surrounding portion 16 in the example shown in FIG. 1C). Also, a hook unit 21 formed by bending a material into two layers is formed at the other end of the movable plate 15 in the longitudinal directions.

This movable plate 15 is set between the first holding unit 11 and the second holding unit 12 of the insulation material 10 so as to be fixed with the hook unit 21 fit with the insulation hook unit 14 loosely and with the post fitting unit 19 fit into the insulation post 13 tightly, and thereby is supported by the insulation material 10 in a cantilevered manner.

The insulation post 13 is made of metal so as to reinforce the cantilever-manner support. When the first terminal unit 2 and the second terminal unit 4 described above are integrated with the insulation material 10 by resin molding, they are molded integratedly with both terminal units, and they are separated electrically from both terminal units by cutting off a portion after the molding.

In the above embedded state, the movable contact 18 of the tongue portion 17 is arranged at a position that faces both the first fixed contact 6 and the second fixed contact 8, i.e., a position at which the movable contact 18 bridges the two fixed contacts.

In the upper portion of this movable plate 15, a bimetal element 22 is arranged as a thermally actuated element. The bimetal element 22 includes a cantilever fixation unit 23 and an inverted operation unit 24, and a fitting lock hole 25 is formed on the cantilever fixation unit 23.

The bimetal element 22 is set between the first holding unit 11 and the second holding unit 12 of the insulation material 10 in the upper portion of the movable plate 15. Then, the free end of the inverted operation unit 24 of the bimetal element 22 (the left end) is held by the insulation hook unit 14 of the movable plate 15, and the fitting lock hole 25 of the cantilever fixation unit 23 is fit into the post fitting unit 19 of the movable plate 15 from the outside.

Thereby, a fixation assisting member 26 having a shape of a lid of a box and made of metal is externally fit with the post fitting unit 19 of the movable plate 15 that is on one hand externally fit with the insulation post 13 of the insulation material 10 and that is on the other hand externally fit with the fitting lock hole 25 of the bimetal element 22.

Thereby, one end of the movable plate 15 (the end having the post fatting unit 19) and one end of the bimetal element 22 (the cantilever fixation unit 23) are firmly held on the second holding unit 12 of the insulation material 10 by the insulation post 13 and the fixation assisting member 26 in a cantilevered manner.

Figure 2A:
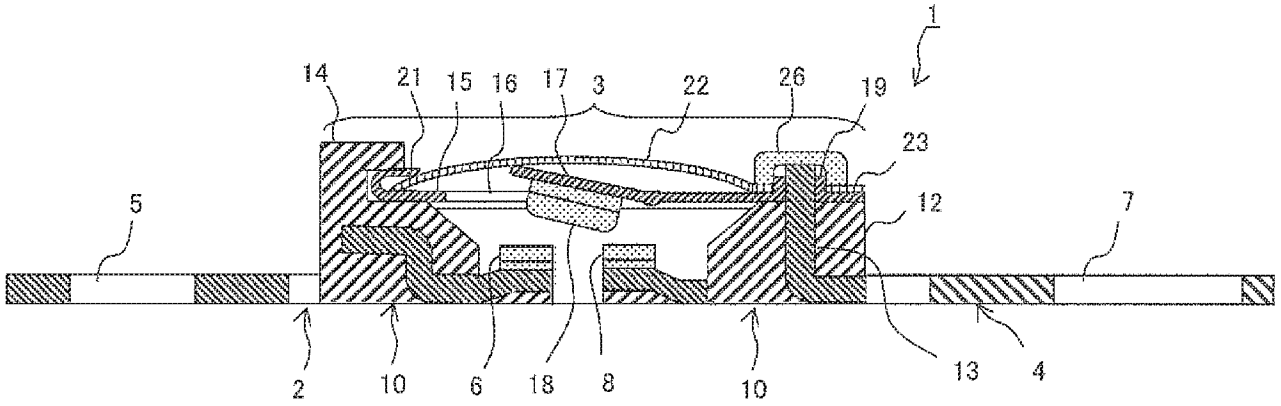
FIG. 2A is a side sectional view showing an operation state of the temperature switch according to example 1.
Figure 2B:
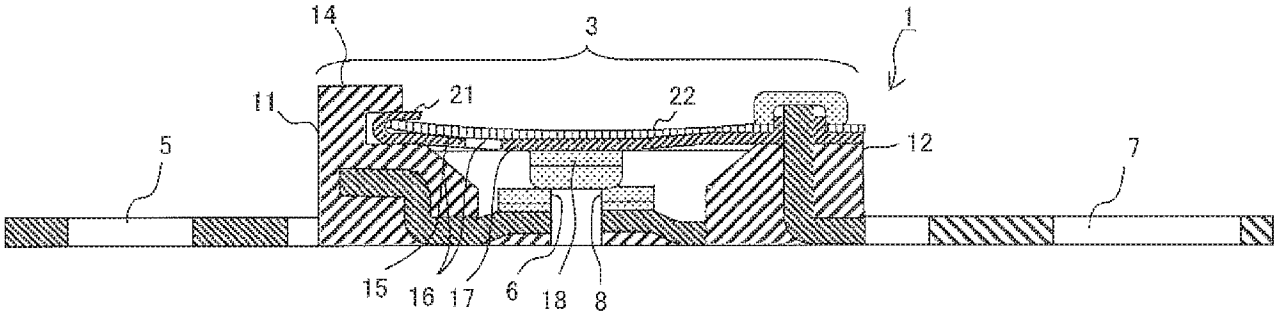
FIG. 2B is a side sectional view showing an operation state of the temperature switch according to example 1.

FIG. 2A and FIG. 2B are side sectional views showing operation states of the temperature switch 1 according to example 1, with FIG. 2A showing a state when the contact is open as the temperature switch 1 and FIG. 2B showing a state when the contact is closed as the temperature switch 1.

Note in FIG. 2A that the same constituents as those in FIG. 1A through FIG. 1E are denoted by the same symbols as those in FIG. 1A through FIG. 1E, and note also in FIG. 2B that only portions necessary for explanations are denoted by the same symbols as those in FIG. 2A.

Also, in all the examples below for the present invention, the temperature switch can be used as a normally open switch (such as one in the state of FIG. 2A at ordinary temperatures) and also as a normally closed switch (such as one in the state of FIG. 2B at ordinary temperatures).

Specifically, when the bimetal element 22 having a convex shape is embedded in the direction of opening the contact at ordinary temperatures, the switch enters the ordinary-temperature-open state shown in FIG. 2A (normally open switch). When the ambient temperature increases in this state, the bimetal element 22 inverts the bending-back direction around a prescribed temperature.

Then, as shown in FIG. 2B, the bimetal element 22 enters a state in which the movable contact 18 is pushed toward the first fixed contact 6 and the second fixed contact 8, the movable contact 18 is brought into contact with the first fixed contact 6 and the second fixed contact 8 so as to close the contact circuit, and a current is passed between the first terminal 5 and the second terminal 7.

When the ambient temperature decreases to reach the recovering temperature of the bimetal element 22 after the closure of the contact circuit, the bending-back direction of the bimetal element 22 is inverted so as to open the movable contact and the two fixed contacts, and the state of a normally open switch is recovered.

When the above the bimetal element 22 is joined in the inverted direction, the switch enters the ordinary-temperature-close state shown in FIG. 2B (normally closed switch). When the ambient temperature becomes abnormally high, the temperature switch configuration becomes as shown in FIG. 2A, with the bimetal element 22 passing an inverted operation so as to break the current.

However, for the convenience of explanations in the examples below, all explanations are based on an assumption that the temperature switch is a normally closed switch, i.e., a switch having its contact closed at ordinary temperatures as shown in FIG. 2B and open at an ambient temperature that is equal to or higher than a prescribed value as shown in FIG. 2A.

A force of a spring bending backward in the direction in which the movable contact 18 moves away from the fixed contacts 6 and 8, i.e., in the contact-opening direction, is applied to the tongue portion 17 in the present example. Note that the movable contact 18 and the fixed contacts 6 and 8 can be joined by using any method including for example welding, gluing, swaging, etc. as long as these members can be fixed to the portions to which they should be joined.

This temperature switch 1 has the movable contact 18 closed with respect to the first fixed contact 6 and the second fixed contact 8 at ordinary temperatures as shown in FIG. 2B so that a current is passed between the first terminal 5 and the second terminal 7.

At that moment, the bimetal element 22 is inversely deforming the bending-back direction into a shape that is convex in each contact direction. The convex-shaped center portion of the bimetal element 22 that has been inversely deformed in each contact direction acts to push the tongue portion 17 of the movable plate 15 while resisting the biasing force based on the spring property.

Thereby, the movable contact 18 is pressed in the direction of the first fixed contact 6 and the second fixed contact 8 together with the tongue port on 17, causing a contact force between the movable contact 18, the first fixed contact 6 and the second fixed contact 8, and a current is passed continuously between the first terminal 5 and the second terminal 7 while this contact force continues.

When prolonged passing of a current between the first terminal 5 and the second terminal 7 generates heat in the contact part or when hot air etc. increases the ambient temperature, the bending-back shape of the bimetal element 22 changes gradually so that the bending-back direction is deformed inversely into a shape that is concave in each contact direction at a prescribed temperature as shown in FIG. 2A, which results in the cancellation of the pressing on the tongue portion 17 and the release of- the biasing force based on the spring property of the tongue portion 17.

This bends back the tongue portion 17 in the opposite direction to the first fixed contact 6 and the second fixed contact 8 by the biasing force of the spring property so that the movable contact 18 moves away from the first fixed contact 6 and the second fixed contact 8 to cancel the contact, and thereby a current is cut off between the first terminal 5 and the second terminal 7.

EXAMPLE 2

Figure 3A:
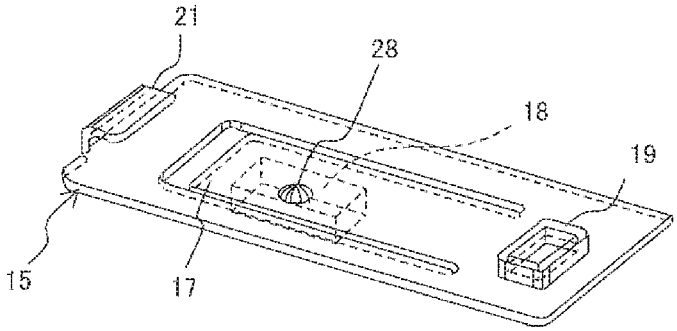
FIG. 3A is a perspective view showing a configuration of a movable plate of a temperature switch according to example 2.
Figure 3B:
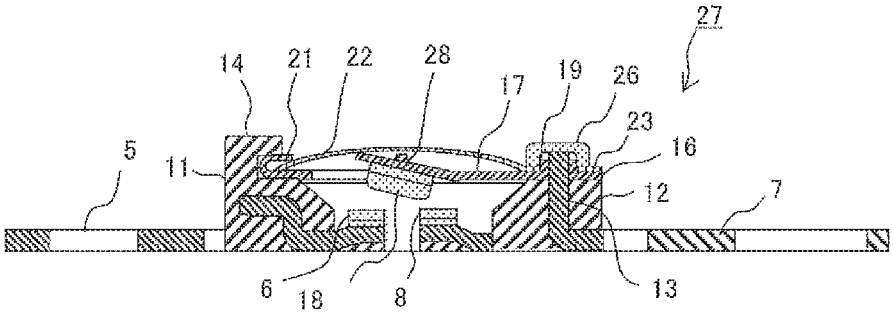
FIG. 3B is a side sectional view showing an operation state of the temperature switch according to example 2.
Figure 3C:
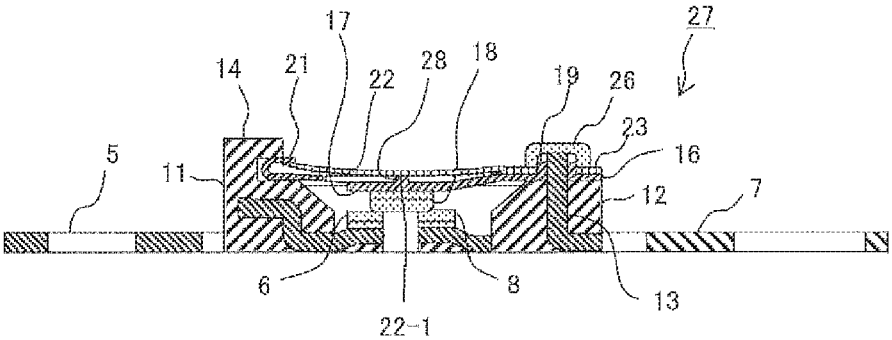
FIG. 3C is a side sectional view showing an operation state of the temperature switch according to example 2.

FIG. 3A is a perspective view showing a configuration of a movable plate of a temperature switch according to example 2, and FIG. 3B and FIG. 3C are side sectional views showing operation states of the temperature switch having that movable plate built into it. Note in FIG. 3A through 3C that the same constituents or functions as those in FIG. 1A through FIG. 1E, FIG. 2A, and FIG. 2B are denoted by the same symbols as those in FIG. 1A through FIG. 1E, FIG. 2A, and FIG. 2B.

As shown in FIG. 3A through FIG. 3C, the tongue portion. 17 of the movable plate 15 of a temperature switch 27 according to example 2 has a projecting portion 28 at a position corresponding to the movable contact 18 on the side opposite to the surface that holds the movable contact 18.

In this configuration, when the movable contact 18 is closed with respect to the first fixed contact 6 and the second fixed contact 8 as shown in FIG. 3B, the bimetal element 22 presses the projecting portion 28 at a center portion 22-1 that is convex shaped in the bending back direction inverted into a shape that is convex in each contact direction. This makes it possible to increase the contact pressure of the movable contact on the fixed contact.

Note that the interlocking relationship between the bimetal element 22, the movable plate 15 and the tongue portion 17 in the operation in which the movable contact 18 opens with respect to the first fixed contact 6 and the second fixed contact similar to that in FIG. 2A regardless of a presence or absence of the projecting portion 28.

EXAMPLE 3

Figure 4A:
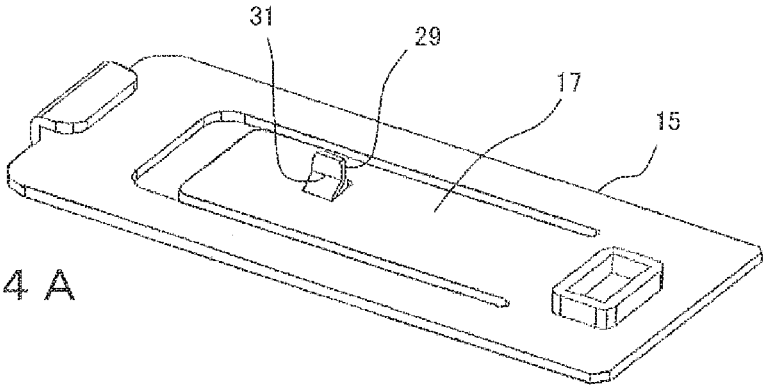
FIG. 4A is a perspective view showing a configuration of a movable plate of a temperature switch according to example 3.
Figure 4B:
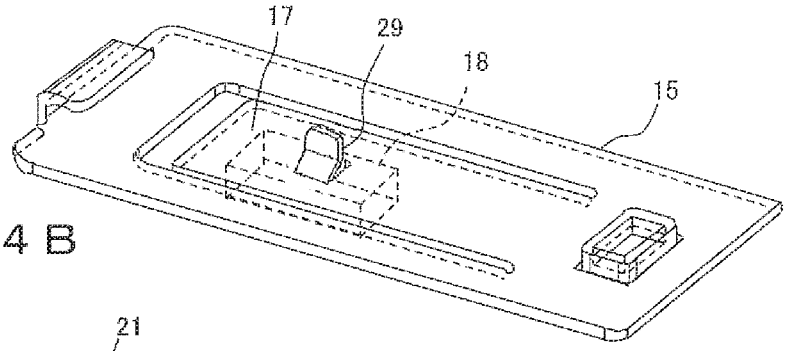
FIG. 4B is a perspective view showing a configuration of a movable plate of a temperature switch according to example 3.
Figure 4C:
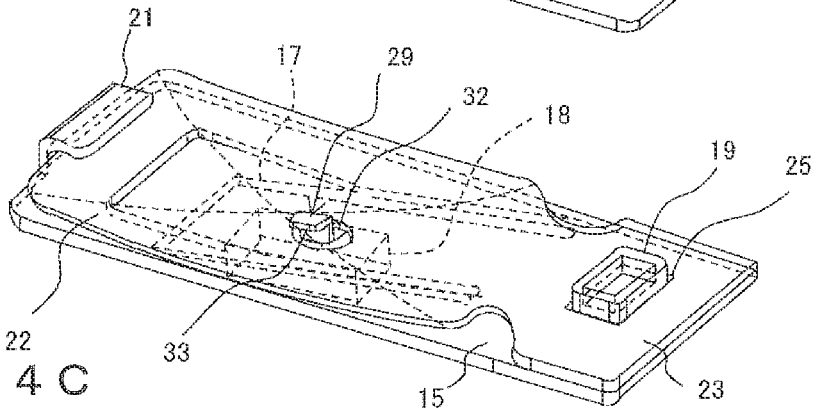
FIG. 4C is a perspective view showing an engagement relationship between the movable plate and the bimetal element of the temperature switch according to example 3 and their operation states.
Figure 4D:
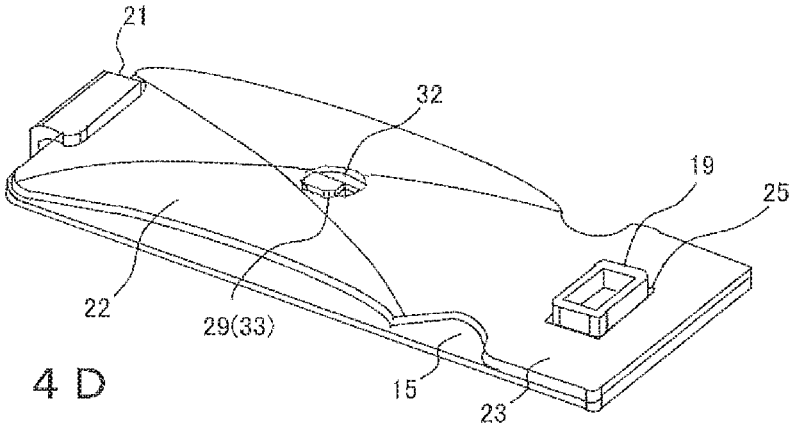
FIG. 4D is a perspective view showing an engagement relationship between the movable plate and the bimetal element of the temperature switch according to example 3 and their operation states.

FIG. 4A and 4B are perspective views showing configurations of a temperature switch and the movable plate 15 according to example 3, and FIG. 4C and FIG. 4D are perspective views showing an engagement relationship between the movable plate 13 and the bimetal element 22 and their operation states. Note that the temperature switch according to example 3 is different from those in examples 1 and 2 in the configurations of the movable plate 15 and the bimetal element 22, and thus is not shown in its entirety.

As shown in FIG. 4A and FIG. 4B, the tongue portion 17 of the movable plate 15 includes a hook-shaped projecting portion 29 at a position corresponding to the movable contact 18 on the side opposite to the surface that holds the movable contact 18. The hook-shaped projecting portion 29 is formed by making a cut in the tongue portion 17 and pulling upward the root of the cut on the side opposite to the movable contact 18.

However, in this phase, the hook-shaped projecting portion 29 is in a state wherein a valley folding portion 31 that is shallow at the center is formed and the pulling upward from the root is just shallow and slanted. On the bimetal element 22, a hole 32 has been formed at a position corresponding to a hook-shaped projection 29 when it is built into the movable plate 15 as shown in FIG. 4C and FIG. 4D.

Accordingly, as shown in FIG. 4C, the hook-shaped projecting portion 29 shown in FIG. 4A and FIG. 4B easily pierces the hole 32 to be exposed over the upper portion of the hole 32 because the valley folding of the valley folding portion 31 is shallow and the pulling upward of the root is shallow when the bimetal element 22 is built into a shape convex toward the movable plate 15 as shown in FIG. 4C.

When the shallow valley folding of the valley folding portion 31 of the hook-shaped projecting portion 29 is bent to 90 degrees and the shallow upward-pulled portion from the root is pulled upward to 90 degrees, a hook 33 that is bent to 90 degrees horizontally with respect to the vertical portion is formed at the tip of the hook-shaped projecting portion 29, which is vertical with respect to the surface of the tongue portion 17. Note that either one of the bending and the pulling upward may be carried out first.

In this configuration, the hook-shaped projecting portion 29 locks the hook 33 at the edge of the hole 32 so as to assist the bending backward of the tongue portion 17 in the direction in which it moves away from the first fixed contact 6 and the second fixed contact 8 when the bimetal element 22 inverts the bending-back direction into a shape that is concave in each contact direction in the temperature switch according to example 3 (state in FIG. 4D, see also FIG. 2A). This enforces the release of the contacts.

When the bimetal element 22 inverts the bending-back direction into a shape that is convex in each contact direction (state in FIG. 4C, see also FIG. 2B) and presses the tongue portion 17 toward the first fixed contact 6 and the second fixed contact 8 in the center portion that is convex shaped in the inverted bending-back direction, the hook-shaped projecting portion 29 makes the hook 33 project to the outside from the hole 32 so as to cancel the locking with the edge of the hole and release the pressing on the tongue portion 17 by the bimetal element 22.

EXAMPLE 4

FIG. 5A through FIG. 5H show steps of forming the tip-portion projection of the tongue portion in the movable plate of the temperature switch according to example 4. Note in FIG. 5A through FIG. 5H that the same constituents or functions as those in FIG. 3A through FIG. 3C are denoted by the same symbols as those in FIG. 3A through FIG. 3C. Also, FIG. 5B, FIG. 5D, FIG. 5E and FIG. 5H perspectively show the back sides of the configurations respectively of FIG. 5A, FIG. 5C, FIG. 5E and FIG. 5G by using dashed lines.

Figure 5A:
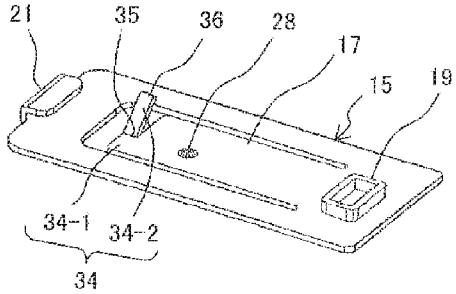
FIG. 5A shows steps of forming a tip-portion projection of a tongue portion in a movable plate of a temperature switch according to example 4.
Figure 5B:
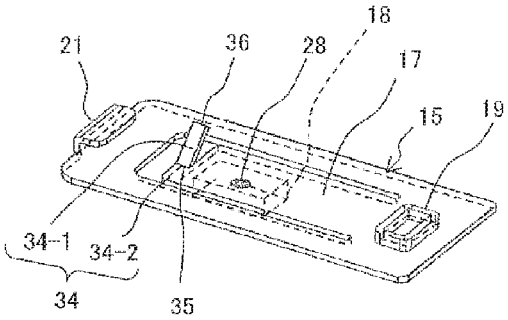
FIG. 5B shows steps of forming a tip-portion projection of a tongue portion in a movable plate of a temperature switch according to example 4.

As shown in FIG. 5A and FIG. 5B, the tongue portion 17 of the movable plate 15 has a small-width portion 34 with a prescribed width on its tip side (free end facing the hook unit 21), the small-width portion 34 being separated from the tip of the tongue portion 17 over half its length from the center, and is separated into a connection portion 34-1 with the tongue portion tip and a disconnection portion 34-2 with the tongue portion tip.

A shallow valley folding 35 is formed at the boundary between the connection portion 34-1 and the disconnection portion 34-2, i.e., at the root of the disconnection portion 34-2, and the disconnection portion 34-2 is pulled diagonally upward (the opposite direction from the surface on which the movable contact 18 is arranged) so as to form a projecting portion 36 (34-2) having a protruding shape.

Figure 5C:
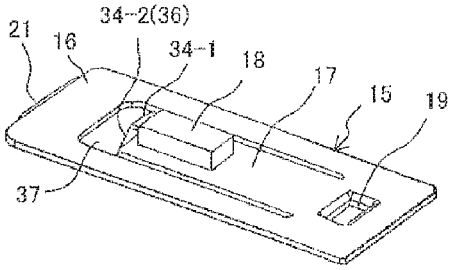
FIG. 5C shows steps of forming at tip-portion projection of a tongue portion in a movable plate of a temperature switch according to example 4.
Figure 5D:
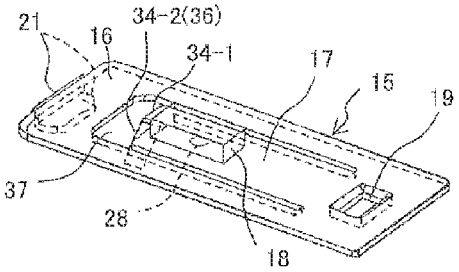
FIG. 5D shows steps of forming a tip-portion projection of a tongue portion in a movable plate of a temperature switch according to example 4.

FIG. 5C and FIG. 5D show the subjects shown in FIG. 5A and FIG. 5B in a vertically inverted state. As shown in FIG. 5C and FIG. 5D, a punch hole 37 is formed between the tip of the tongue portion 17 and the surrounding portion 16 on the hook unit 21 side of the movable plate 15, the punch hole 37 having an interval greater than that removed in the punching process on the side surface of the tongue portion 17.

Figure 5E:
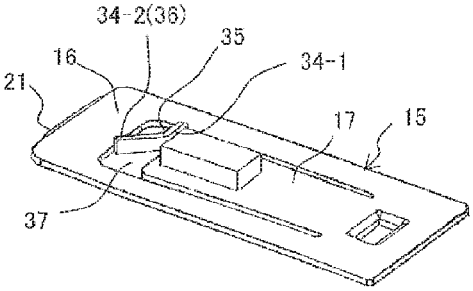
FIG. 5E shows steps of forming a tip-portion projection of a tongue portion in a movable plate of a temperature switch according to example 4.
Figure 5F:
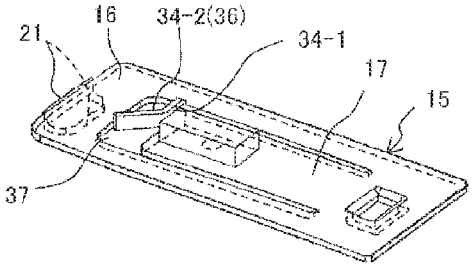
FIG. 5F shows steps of forming a tip-portion projection of a tongue portion in a movable plate of a temperature switch according to example 4.

FIG. 5E and FIG. 5F show states in which the connection portion 34-1 of the small-width portion 34 has been bent to 90 degrees to the side of the surface on which the movable contact 18 is arranged, from the states shown in FIG. 5C and FIG. 5D, respectively. The projecting portion 36 (34-2) shown in FIG. 5C and FIG. 5D has shallow valley folding of the valley folding 35 as described above and the pulling-upward angle is inclined.

Accordingly, in accordance with the 90-degree bending of the connection portion 34-1, the projecting portion 36 (34-2) can easily pass through the punch hole 37 from the side opposite to the surface on which the movable contact 18 is arranged so as to move out to the side of the surface on which the movable contact 18 is arranged.

Figure 5G:
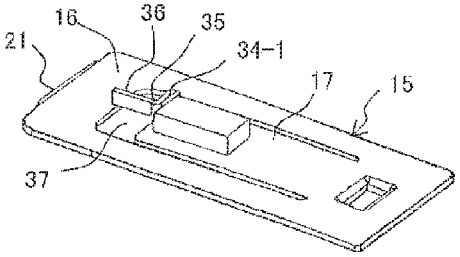
FIG. 5G shows steps of forming a tip-portion projection of a tongue portion in a movable plate of a temperature switch according to example 4.
Figure 5H:
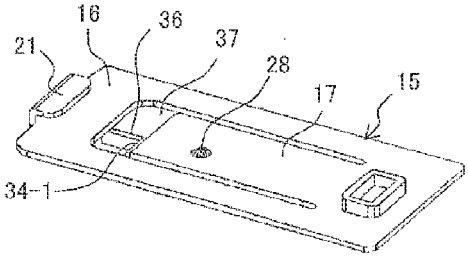
FIG. 5H shows steps of forming a tip-portion projection of a tongue portion in a movable plate of a temperature switch according to example 4.

When the valley folding of the valley folding 35 of the projecting portion 36 is bent to 90 degrees as shown in FIG. 5G and FIG. 5H, the projecting portion 36 extends straight out in the direction of the surrounding portion 16 of the side of the hook unit 21 of the movable plate 15 so that the tip of the projecting portion 36 abuts and gets engaged with the edge of the punch hole 37.

FIG. 5H shows the subject of FIG. 5G in a vertically inverted state. As described first in example 1, a force of a spring bending backward in the direction in which the movable contact 18 moves away from the fixed contacts 6 and 8, i.e., in the contact-opening direction, is applied to the tongue portion 17.

As shown in FIG. 5G and FIG. 5H, in a free state with no external forces applied to the tongue portion 17, the tip of the projecting portion 36 abuts the surrounding portion 16 in the tip direction of the tongue portion 17 (direction of the hook unit 21), i.e., the edge of the punch hole 37 from the contact side, so as to suppress the bending backward of the tongue portion 17 while resisting the biasing force based on the spring property.

Figure 6A:
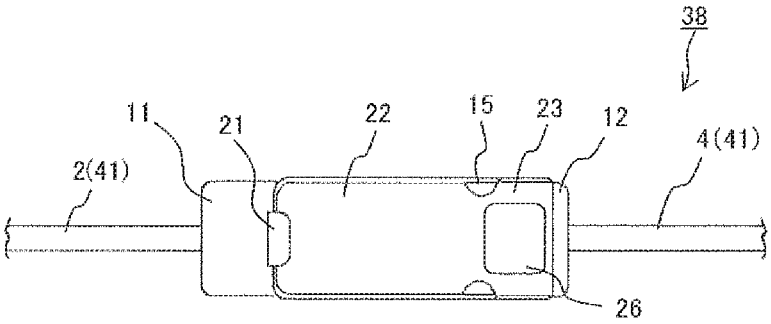
FIG. 6A is a plan view of a temperature switch in which the movable plate having the configuration of example 4 has been embedded.
Figure 6B:
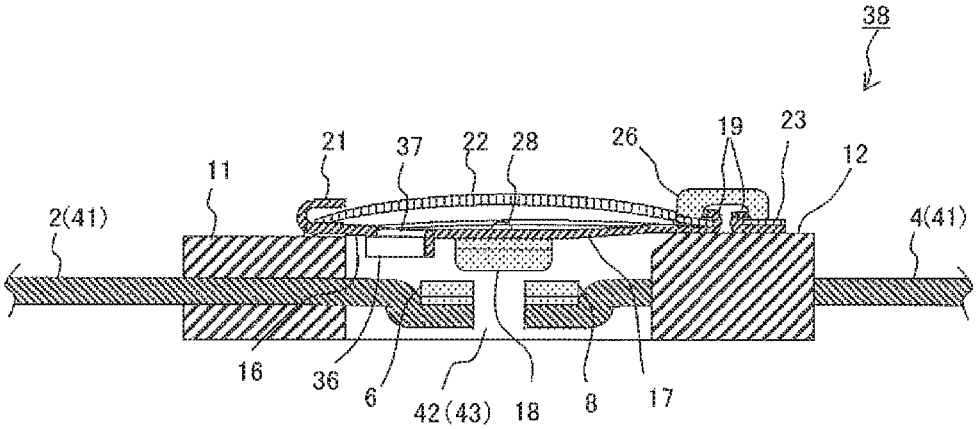
FIG. 6B is a side sectional view showing an operation state of FIG. 6A.
Figure 6C:
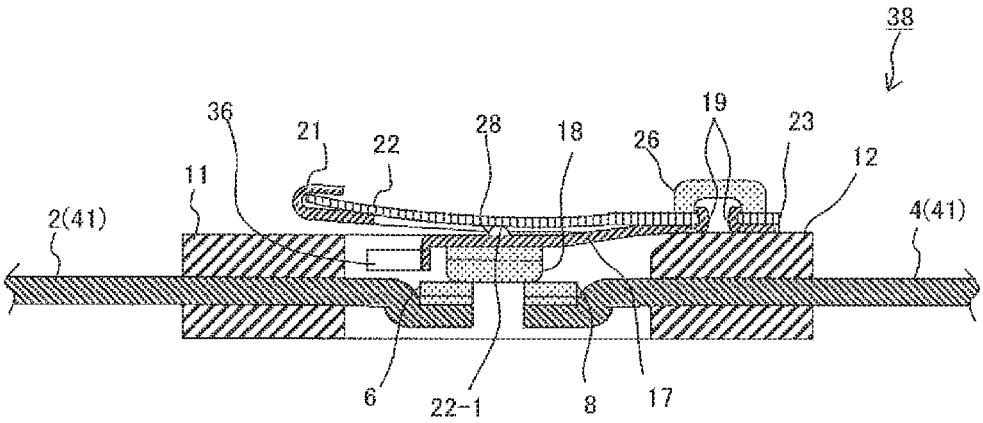
FIG. 6C is a side sectional view showing, an operation state of FIG. 6A.

FIG. 6A is a plan view of the temperature switch 38 in which the movable plate 15 having the above configuration has been embedded, and FIG. 6B and FIG. 6C are sectional views showing the operation states thereof. Note in FIG. 6A through 6C that the same constituents or functions as those in FIG. 2A and FIG. 2B are denoted by the same symbols as those in FIG. 2A and FIG. 2B.

Also, for this temperature switch 38 according to example 4, a wire 41 is used as a material for the first terminal unit 2 and the second terminal unit 4 instead of rolled sheet materials. When the wire 41 is used for the first terminal unit 2 and the second terminal unit 4 as described above, a contact accommodation unit 43 formed of insulation resin is provided in a body center portion 42.

Then, through holes for the wire 41 are provided to the insulation resin on both sides of this body center portion 42. The wire 41 is formed by shaping a round wire so that the wire has a square section, and is inserted into through holes having the same shape. This can prevent the wire 41 from rotating.

Further, it is also possible to crush the tip of the wire 41 extruding into the contact accommodation unit 43 of the body center portion 42 after passing through the through hole and to weld the first fixed contact 6 and the second fixed contact 8 at a prescribed interval in order to configure them into a pair of fixed contacts and a lead terminal.

Also, on this temperature switch 38 according to example 4, the insulation hook unit 14 described in examples 1 through 3 is not formed on the upper portion of the first holding unit 11 that holds the connection part between the first terminal unit 2 and the first fixed contact 6.

Even when the insulation hook unit 14 is not formed on the upper portion of the first holding unit 11 and the movable plate 15 is fixed by the second holding unit 12 alone in a cantilevered manner as described above, the movable plate 15 is given a spring force of bending backward toward the side opposite to the tongue portion 17, i.e., to the fixed contact side.

Accordingly, because the hook unit 21 is biased in the direction of abutting on the upper surface of the first holding unit 11 continuously, the same operation as in a case when the hook unit 21 is held by the insulation hook unit 14 is obtained similarly to the cases of the other examples.

In this temperature switch 38, while the contact is open as shown in FIG. 6B, the bimetal element 22 inverts the bending-back direction into a shape that is concave in each contact direction and cancels the pressing on the tongue portion 17, and when the tongue portion 17 becomes free, the tongue portion 17 tends to bend back the movable contact 18 in the direction in which it moves away from the first fixed contact 6 and the second fixed contact 8.

Then, as shown in FIG. 5G, FIG. 5H and FIG. 6B, the tip of the projecting portion 36 of the tongue portion 17 abuts the surrounding portion 16 (edge of the punch hole 37) in the direction of the hook unit 21 from the contact side. This prevents the tongue portion 17 from being brought into contact with the bimetal element 22 by the effect of the projecting portion 36 while the contact is open.

If the tongue portion 17 is in contact with the bimetal element 22 while the contact is open, the tongue portion 17 operates as a force preventing the bending force of the bimetal element 22 that changes toward the inversion when a change in the ambient temperature inverts the bimetal element 22.

In the present example, because the projecting portion 36 prevents the tongue portion 17 from being brought into contact with the bimetal element 22 by the biasing force of the spring property thereof while the contact is open, the bending force of the bimetal element 22 that changes toward the inversion upon the initial movement of the inversion of the bimetal element 22 that transitions toward the closure of the contact from the opening of the contact is not prevented.

Thereby, the bimetal element 22 does not receive resistance against the operation toward the inversion upon the initial movement of the inversion, making it possible to conduct an inversion operation having a bias at an inherent inversion temperature and thereby to increase the force in the contact direction of the center portion of the bimetal element 22

EXAMPLE 5

Figure 7A:
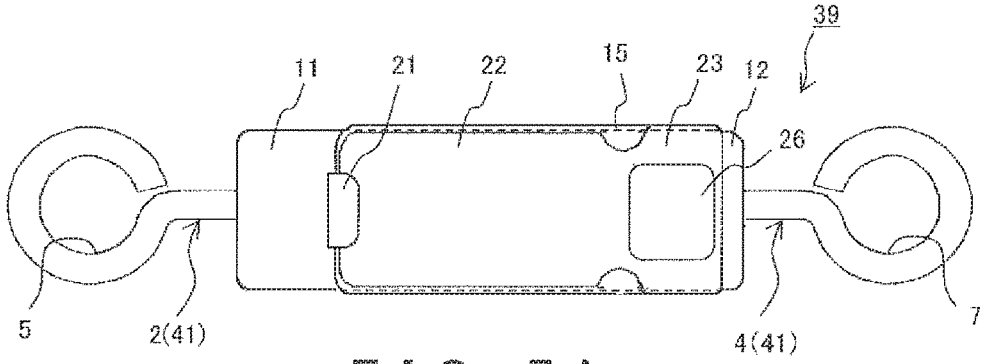
FIG. 7A is a plan view of a temperature switch according example 5.
Figure 7B:
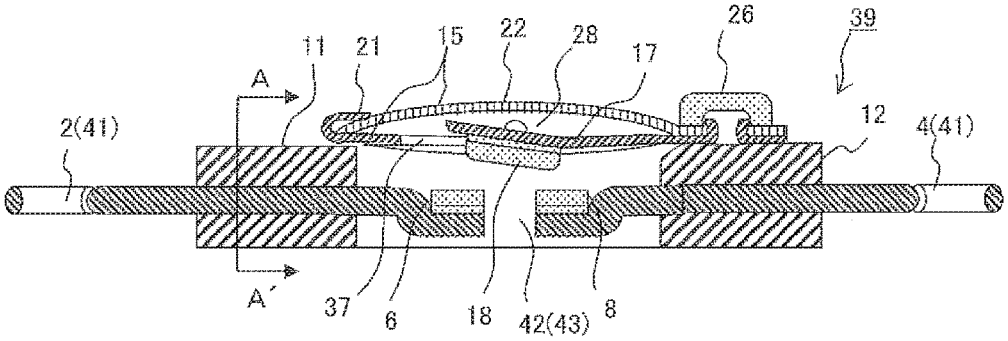
FIG. 7B is a sectional view showing an operation state of FIG. 7A.
Figure 7C:
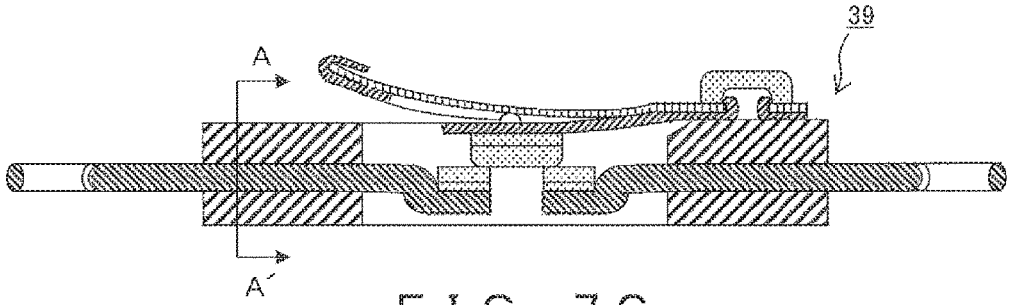
FIG. 7C is a sectional view showing an operation state of FIG. 7A.
Figure 7D:
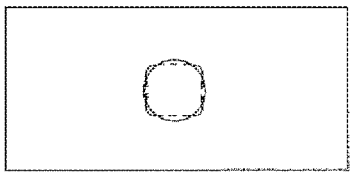
FIG. 7D shows an example of a sectional view along line A-A' in FIG. 7B and FIG. 7C.
Figure 7E:
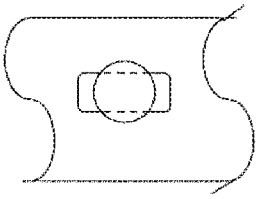
FIG. 7E shows an example of a sectional view along line A-A' in FIG. 7B and FIG. 7C.
Figure 7F:
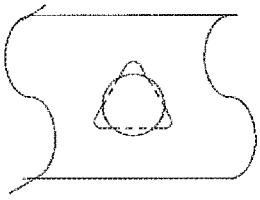
FIG. 7F shows an example of a sectional view along line A-A' in FIG. 7B and FIG. 7C.

FIG. 7A is a plan view of a temperature switch according to example 5, FIG. 7B and FIG. 7C are sectional views showing the operation states thereof, and. FIG. 7D, FIG. 7E and FIG. 7F show three examples of sectional views along line A-A' in FIG. 7B and FIG. 7C. Note in FIG. 7A through 7C that the same constituents or functions as those in FIG. 6A through FIG. 6C are denoted by the same symbols as those in FIG. 6A through FIG. 6C.

This temperature switch 39 according to example 5 as well uses the wire 41 as a material of the first terminal unit 2 and the second terminal unit 4 instead of rolled sheet materials. The method of building these in the contact accommodation unit 43 is similar to that in the cases of FIG. 6A through FIG. 6C.

This temperature switch 39 according to example 5 as well does not have the insulation hook unit 14 of examples 1 through 3 formed on the upper portion of the first holding unit 11. Also, the projecting portion 36 of example 4 is not formed.

In this configuration too, the temperature switch 39 operates and functions roughly similarly to the temperature switch 27 according to example 2 shown in FIG. 3A through FIG. 3C.

Also, in the example 5, the lead terminal unit is not straight but has received a rounding process so that it has a round hole shape as shown in FIG. 7A through FIG. 7C. This shape facilitates the connection with an external power line.

Note that while the section of the portion through which a lead wire of a wire pierces the insulation portion is square shaped as shown in FIG. 7D in order to prevent the lead wire from rotating in examples 4 and 5 above, other shapes can be used as long as a function of preventing the lead wire from rotating is achieved, and it can be for example rectangular or triangular as shown in FIG. 7E and. FIG. 7F or can be other polygonal shapes.

As described above, according to the respective embodiments of the present invention, the current-passing path of the switch is straight and the first and the second terminals are arranged on both ends of the linear directions of the current-passing path, eliminating the possibility of a short circuit occurring between the first and second terminals, and the switch can be used without any problems even with a high voltage, which causes large breaking current or inrush current upon the opening and closing of the switch.

Also, because the first and second terminals are extended in the linear directions and two fixation terminals of the first and second terminals are arranged in the linear direction, the interval between the two fixed contacts can be adjusted with the width of the switch mechanism unit formed to be the minimum possible size and the invention can easily be embedded in small electric devices regardless of the level of used voltages.

Also, because there are no paths in which a current flows to the switch mechanism unit except the contact parts of the movable contact and the fixed contact, only a very small amount of heat is generated by the current passing through the switch even with a high voltage, making it possible to minimize the reduction in the actual operation temperature, which is easily affected by the internal heat generation.

As a matter of course, various changes can be made in the above examples without departing from the spirit of the embodiments.

The present invention can be used for a compact temperature switch that passes or breaks a large current used by a compact, electrical appliance using a large current such as in a hairdryer etc.

SYMBOLS

1 TEMPERATURE SWITCH ACCORDING TO EXAMPLE 1
2 FIRST TERMINAL UNIT
3 SWITCH BODY UNIT
4 SECOND TERMINAL UNIT
5 FIRST TERMINAL
6 FIRST FIXED CONTACT
7 SECOND TERMINAL
8 SECOND FIXED CONTACT
10 INSULATION MATERIAL
11 FIRST HOLDING UNIT
12 SECOND HOLDING UNIT
13 INSULATION POST
14 INSULATION HOOK UNIT
15 MOVABLE PLATE
16 SURROUNDING PORTION
17 TONGUE PORTION
18 MOVABLE CONTACT
19 POST FITTING UNIT
21 HOOK UNIT
22 BIMETAL ELEMENT
22-1 CENTER PORTION THAT IS CONVEX SHAPED IN THE BENDING BACK DIRECTION
23 CANTILEVER FIXATION UNIT
24 INVERTED OPERATION UNIT
25 FITTING LOCK HOLE
26 FIXATION ASSISTING MEMBER
27 TEMPERATURE SWITCH ACCORDING TO EXAMPLE 2
28 PROJECTING PORTION
29 HOOK-SHAPED PROJECTING PORTION
31 VALLEY FOLDING PORTION
32 HOLE
33 HOOK
34 SMALL-WIDTH PORTION
34-1 CONNECTION PORTION WITH TONGUE PORTION TIP
34-2 DISCONNECTION PORTION WITH TONGUE PORTION TIP (PROJECTING PORTION)
35 VALLEY FOLDING
36 PROJECTING PORTION
37 PUNCH HOLE
38 TEMPERATURE SWITCH ACCORDING TO EXAMPLE 4
39 TEMPERATURE SWITCH ACCORDING TO EXAMPLE 5
41 WIRE
42 BODY CENTER PORTION
43 CONTACT ACCOMMODATION UNIT

What is claimed is:

1. A temperature switch comprising:

a first terminal unit, a switch body unit, and a second terminal unit that are sequentially arranged in line, wherein the first terminal unit includes a first terminal formed at an outer end and a first fixed contact provided at an inner end that is inside the switch body unit, the second terminal unit includes a second terminal formed at an outer end and a second fixed contact that is provided at an inner end inside the switch body unit and that has a prescribed interval from the first fixed contact, the switch body unit includes an insulation material, a movable plate and a bimetal element, the insulation material includes a first holding unit that holds a connection part between the first terminal and the first fixed contact, a second holding unit that holds a connection part between the second terminal and the second fixed contact, and a cantilever holding unit that holds the movable plate and the bimetal element in a state in which one end of the movable plate and one end of the bimetal element overlap, the movable plate is set between the first holding unit and the second holding unit, includes a hook unit formed at an end opposite to the one end of the movable plate, and includes a tongue portion of the movable plate that is formed in a center portion of the movable plate and that is separated from a surrounding portion of the movable plate except for by a root portion of the tongue portion, the tongue portion has one movable contact joined to a surface facing the first fixed contact and the second fixed contact, and a spring property of bending the movable contact in a direction in which the movable contact moves away from the first fixed contact and the second fixed contact, and the bimetal element is held at an end opposite to the one end of the bimetal element by the hook unit of the movable plate, inverts into a shape that has a concave surface facing the movable contact when the movable contact opens with respect to the first fixed contact and the second fixed contact, and releases a biasing force of the spring property of the tongue portion, and inverts into a shape that has a convex surface facing the movable contact when the movable contact closes with respect to the first fixed contact and the second fixed contact, and a center portion of the convex surface presses the tongue portion to close the moveable contact with respect to the first fixed contact and the second fixed contact.

2. The temperature switch according to claim 1, wherein the cantilever holding unit is formed in an upper portion of one of the first holding unit and the second holding unit of the insulation material.

3. The temperature switch according to claim 2, wherein the cantilever holding unit includes a metal member that is insulated from the first fixed contact and the second fixed contact as a fixation assisting member that ensures fixation of a holding position at which the movable plate and the bimetal element are held in a cantilevered manner.

4. The temperature switch according to claim 1, wherein the first terminal unit and the second terminal unit include a flat-plate metal material.

5. The temperature switch according to claim 1, wherein the tongue portion has a projecting portion at a position corresponding to the movable contact on a side opposite to a surface that holds the movable contact, and the bimetal element presses the projecting portion via the center portion of the convex surface when the movable contact closes with respect to the first fixed contact and the second fixed contact.

6. The temperature switch according to claim 1, wherein the bimetal element has a hole at a position facing a side opposite to a surface holding the movable contact of the tongue portion, the tongue portion includes a hook-shaped projection at a position facing the hole of the bimetal element, the hook-shaped projection assists bending of the tongue portion in a direction in which the tongue portion moves away from the first fixed contact and the second fixed contact by locking a hook at an edge of the hole when the bimetal element inverts into a shape that has a concave surface facing the movable contact, and makes the hook project from the hole so as to release locking with the edge of the hole so as to freely press on the tongue portion by the bimetal element when the bimetal element inverts into a shape that has a convex surface facing the movable contact and presses the tongue portion in a direction of the first fixed contact and the second fixed contact via the center portion of the convex surface.

7. The temperature switch according to claim 1, wherein the tongue portion includes a projecting portion that has a protruding shape at a tip, and when the bimetal element inverts into a shape that has a concave surface facing the movable contact, the projecting portion abuts the surrounding portion from a contact side at a tip of the tongue portion so as to stop the tongue portion from bending and thereby prevents the tongue portion from being brought into contact with the bimetal element by a biasing force of the spring property.

8. The temperature switch according to claim 1, wherein each of the first terminal unit and the second terminal unit include a metal round bar material, and a held portion of each of the metal round bar materials protrude into either the first holding unit or the second holding unit and has a section deformed into a polygon.

* * * * *